US010959493B2

(12) United States Patent
Raynolds et al.

(10) Patent No.: US 10,959,493 B2
(45) Date of Patent: Mar. 30, 2021

(54) ATTACHMENT MECHANISM FOR FACE MASK

(71) Applicants: Gabriel Raynolds, Tallahassee, FL (US); Andrew James Bilardello, Jacksonville Beach, FL (US); Emilio Rodriguez, Tallahassee, FL (US)

(72) Inventors: Gabriel Raynolds, Tallahassee, FL (US); Andrew James Bilardello, Jacksonville Beach, FL (US); Emilio Rodriguez, Tallahassee, FL (US)

( * ) Notice: Subject to any disclaimer, the term of this patent is extended or adjusted under 35 U.S.C. 154(b) by 89 days.

(21) Appl. No.: 16/507,937

(22) Filed: Jul. 10, 2019

(65) Prior Publication Data

US 2021/0007444 A1 Jan. 14, 2021

(51) Int. Cl.
*A44B 11/04* (2006.01)
*A42B 3/28* (2006.01)

(52) U.S. Cl.
CPC ..... *A44B 11/04* (2013.01); *A42B 3/288* (2013.01)

(58) Field of Classification Search
CPC .... A44B 11/04; A42B 3/288; A61M 16/0605; A61M 16/0615; A61M 16/0644
See application file for complete search history.

(56) References Cited

U.S. PATENT DOCUMENTS

2003/0126766 A1* 7/2003 Messmer ..... A63C 13/006 36/122
2007/0163151 A1* 7/2007 Monsees ..... A63C 13/001 36/122
2010/0205784 A1* 8/2010 Yang ..... F16G 11/12 24/115 H
2014/0144430 A1* 5/2014 Dolan ..... A62B 17/04 128/201.23
2015/0151070 A1* 6/2015 Capra ..... A61M 16/0683 128/207.11
2015/0352308 A1* 12/2015 Cullen ..... A61M 16/0683 128/205.25
2019/0175863 A1* 6/2019 Hocking ..... A61M 16/0616
2019/0192330 A1* 6/2019 Theriot ..... A61F 5/028
2019/0351171 A1* 11/2019 Islava ..... A61M 16/0683

* cited by examiner

*Primary Examiner* — Corey N Skurdal
(74) *Attorney, Agent, or Firm* — Adrienne Love

(57) ABSTRACT

A device for donning a face mask. Straps on either side of the back of the mask are connected to each other through a looped handle. When pulled by the user, the handles tighten the straps of the mask to create an airtight seal on the mask. The handles eliminate the need to separately tighten each individual strap to create the airtight seal and allow the user to tighten the mask even if the user is wearing gloves. The device may also include an adherent material attached to the back of the mask and the handles such that the handles have a resting platform once they are adjusted by the user.

18 Claims, 8 Drawing Sheets

ATTACHMENT MECHANISM FOR FACE MASK

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND

1. Field of the Invention

This invention relates to the field of devices made for securing a face mask. More specifically, the invention relates to an attachment mechanism that makes it possible for the user to efficiently, safely, and more expediently secure a face mask.

2. Description of the Related Art

The present invention is applicable to a wide variety of headgear and should not be viewed as being limited to any one type. Firefighters, rescue workers, police, military personnel and others often wear sealed face masks to provide safety or breathable air to the user when the surrounding atmosphere is dangerous. Some face masks include a high-pressure tank, a pressure regulator and an inhalation connection (e.g. full-face mask). Other face masks attach to an air supply and a filter via a regulator. The face mask must be tightened until an air tight seal forms to enable the user to safely navigate through a contaminated atmosphere. These face masks seal the user's face from the surrounding atmosphere. A prior art face mask 10 is illustrated in FIG. 1. The mask 10 typically contains a mouthpiece 20 (or connection to a source of breathing gas), faceplate 14, frame 16, seal (soft skirt) 18 and an attachment mechanism, typically comprised of buckles 24, straps 12 and a central patch 22. These face masks are often sealed through systems containing three to five straps 12 connected to the seal 18 via at least three buckles 24. When the seal 18 is in place around the outline of the user's face and the central patch 22 rests on the back of the head, the face mask 10 is secured by pulling the terminal end of each strap 12. As the terminal end of each strap 22 is pulled, the length of each strap 12 between buckle 24 and central patch 22 shortens thereby tightening the face mask 10 around the face of the user. Securing a face mask is impossible (or extremely difficult) when a user, such as firefighter, police, or military personnel, are wearing bulky gloves for safety or need to secure a face mask quickly, such as in an emergency. Therefore, firefighters, police, or military personnel, for example, often remove their gloves to secure a face mask, making the hands susceptible to injury and taking valuable time. Commonly, at least four straps must be tightened to properly seal the mask, which takes valuable time. This also creates a safety hazard in situations where the user must first take off protective gloves in order to properly seal the mask.

Further, the terminal end of the straps 22 often obstruct the seal 18 by inadvertently getting stuck between the user's face and the seal 18 itself. This can be bothersome and again time consuming to correct. The above-referenced inefficiencies delay the start to a potential lifesaving mission where seconds can be important.

For the foregoing reasons, there is a need for an attachment mechanism that allows the user to effectively and efficiently tighten a face mask with one pull on either side of a face mask, without requiring the terminal end of each strap to be tightened independent of one another. The present invention achieves these objectives and more.

REFERENCE NUMERALS IN THE DRAWINGS

Figure 1:
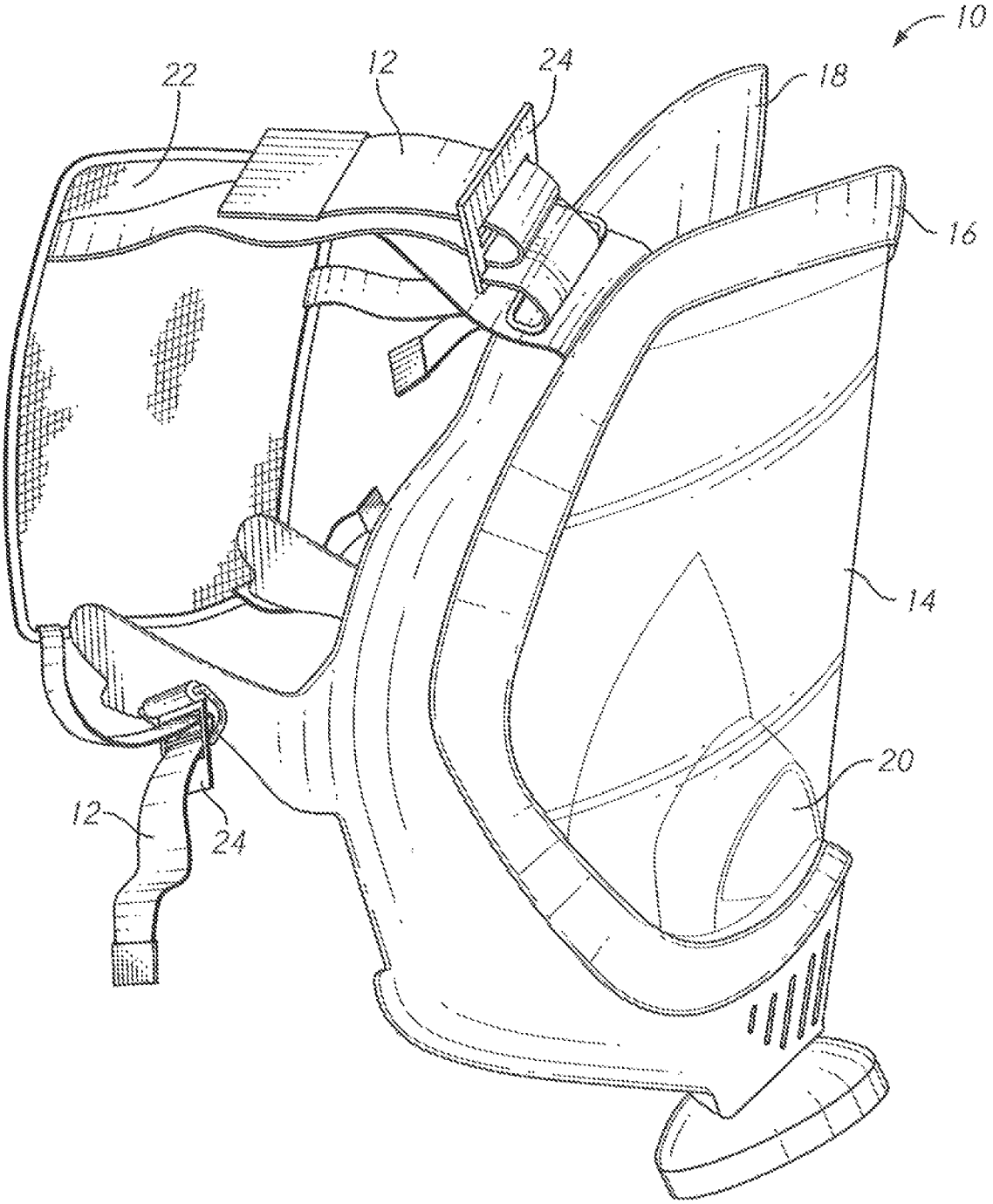
FIG. 1 (PRIOR ART)
FIG. 1 is a perspective view, showing a prior art face mask for a breathable apparatus.

10 face mask
12 prior art strap
13 modified strap
14 faceplate
16 frame
18 seal (skin)
20 mouthpiece
22 central patch
24 buckle
26 attachment mechanism
28 connecting member
30 link
32 terminal end
34 connecting end
36 adherent material
38 user

DETAILED DESCRIPTION

Each reference to features of the present invention herein is to be understood to includes all possible combinations of such features. For example, where a feature is disclosed in the context of a particular aspect or embodiment of the invention, or a particular claim, that feature can also be used, to the extent possible, in combination with and/or in the context of other particular aspects and embodiments of the invention, and in the invention generally. The term "comprises" and grammatical equivalents thereof are used herein to mean that other components are optionally present. The term "at least" followed by a number is used herein to denote the start of a range beginning with that number. For example, "at least 2" means 2 or more than 2.

Figure 2:
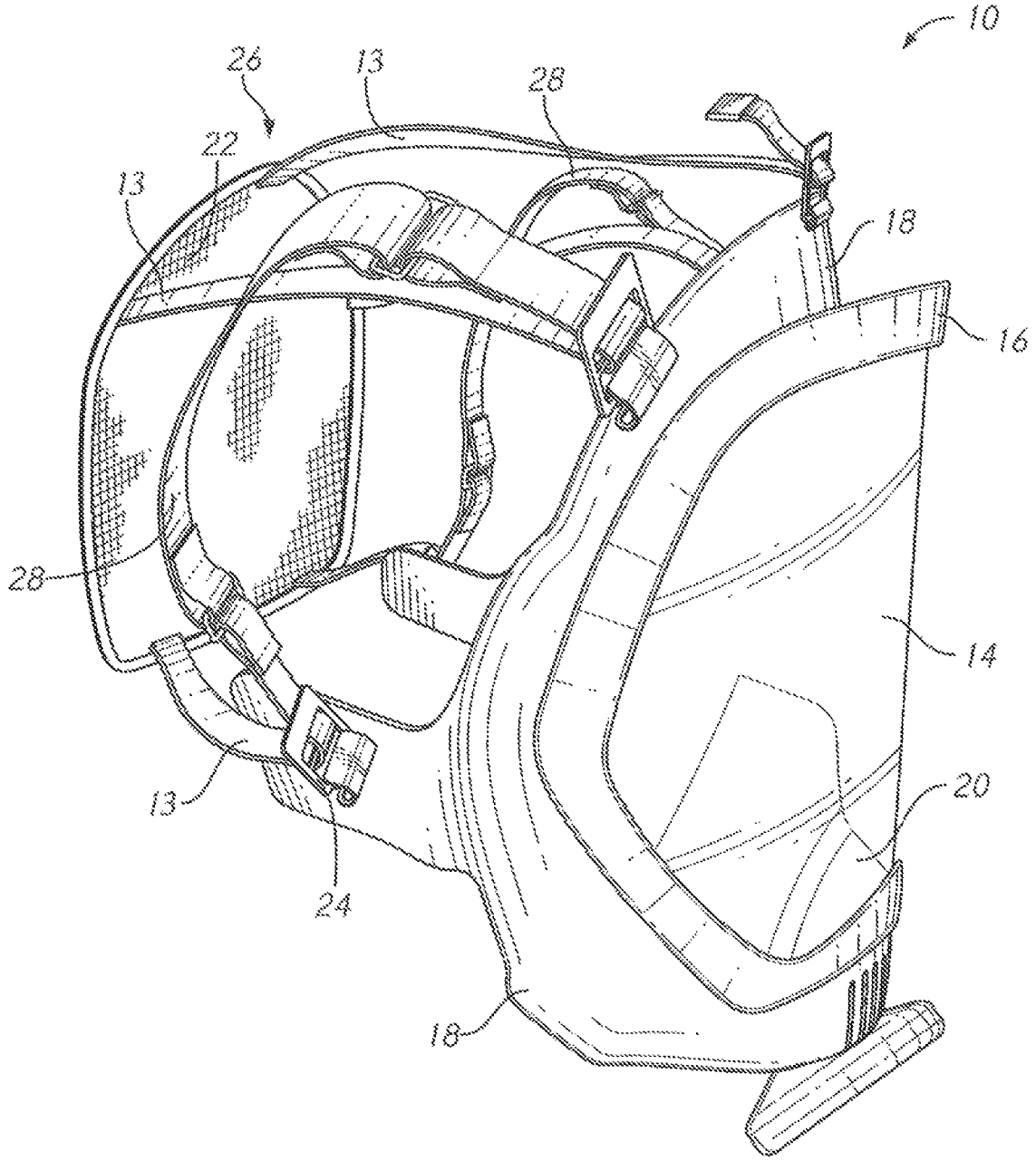
FIG. 2 is a perspective view, showing the present invention.

FIG. 2 illustrates one embodiment of the present attachment mechanism 26. Face mask 10 is generally comprised of a faceplate 14, frame 16, mouthpiece 20, seal (or skirt) 18, a series of buckles 24 and the present attachment mechanism 26 (modified straps 13, connecting member 28 and central patch 22). As an example, face mask 10 may be a self-contained breathing apparatus or any other face mask that seals. Frame 16 of face mask 10 which encircles the outline of the user's face, connects the transparent faceplate 14 to the seal 18. Seal 18 includes at least four attachment points that accept buckles 24. Modified straps 13 are engaged with buckles 24 . . . allowing straps 13 to move through and engage with buckles—such that they exert of force on seal 18 when tightened. The present attachment mechanism 26 is generally comprised of modified straps 13, connecting member 28 and central patch 22. At least four modified straps 13 connect to central patch 22 and are looped through at least four buckles 24. The reader will appreciate that the term "buckle" means any catch with a hinged pin or like piece, capable of receiving and attaching straps 13 through the catch.

A connecting member 28, having a first connecting end 34 and a second connecting end 34 (FIG. 7), is linked to the terminal end 32 of at least two modified straps 13 on a first side of face mask 10 at a connection point (shown in the current embodiment as a loop). Terminal end of modified straps 13 is therefore defined as the end closest to connecting member 28, here a secure loop (as shown in FIG. 2). Initial end of modified straps 13 connects directly to central patch 22, opposite terminal end. A second connecting member 28 is linked to the terminal ends of at least two modified straps 13 on a second side of face mask 10 at another connection point.

Figure 3:
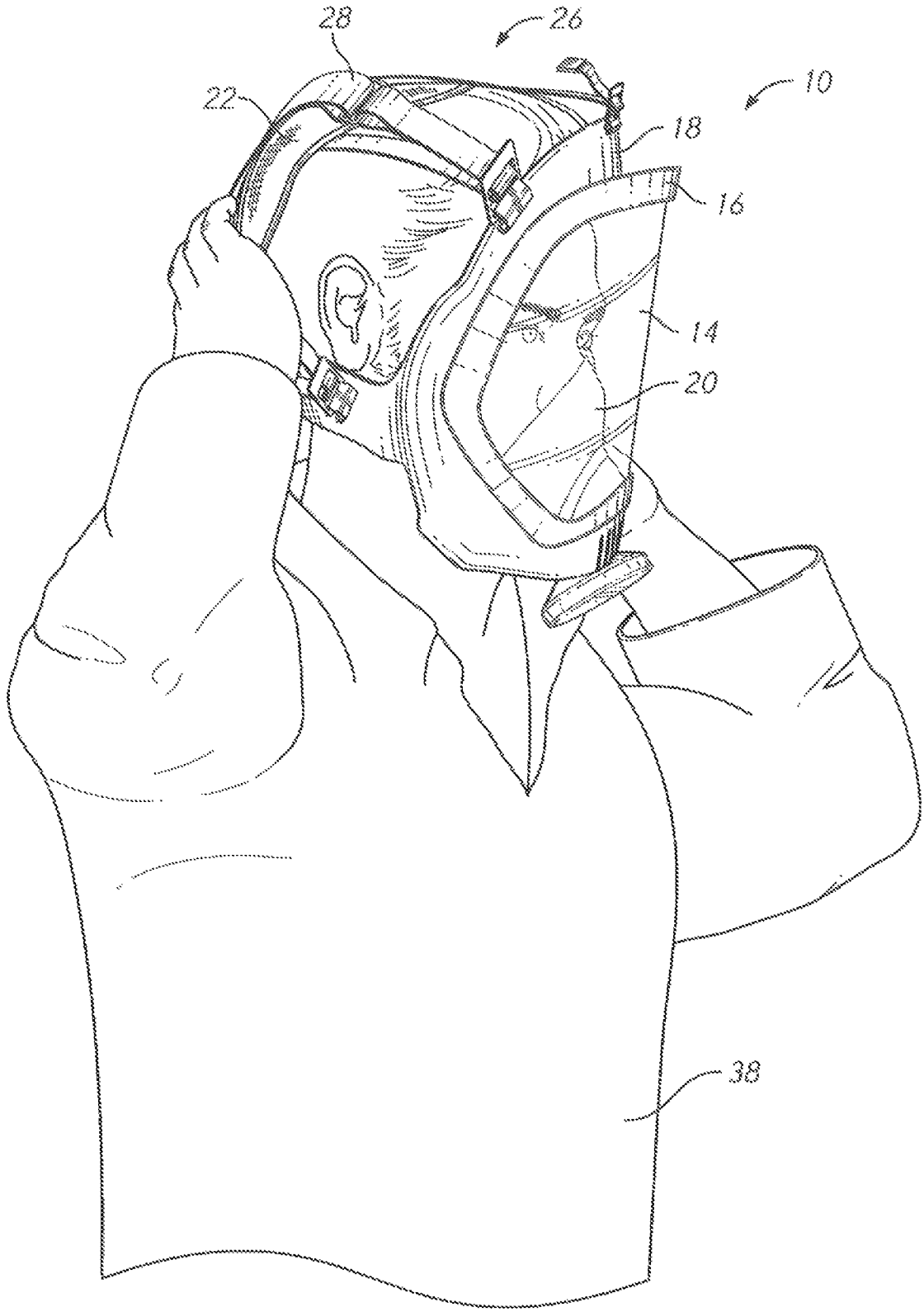
FIG. 3 is a perspective view, showing an embodiment of the present invention while in use.

Connecting member 28 acts as a handle allowing a user 38, shown in FIG. 3, to pull backwards on connecting member 28 to tighten two modified straps 13 with one pull simultaneously. This allows the user to secure face mask 10 while wearing bulky gloves such that the user will not be required to take of gloves and expose his or her hands to a safety hazard. Even if the user is not wearing gloves, connecting member 28 connected to modified straps 13 will allow for quickly and more efficient securing of face mask 10. The reader will note that because there are two connecting members 28 on either side of face mask 10, the user can, using either or both hands, easily tighten four modified straps 13 simultaneously by pulling both connecting members 28.

Figure 4:
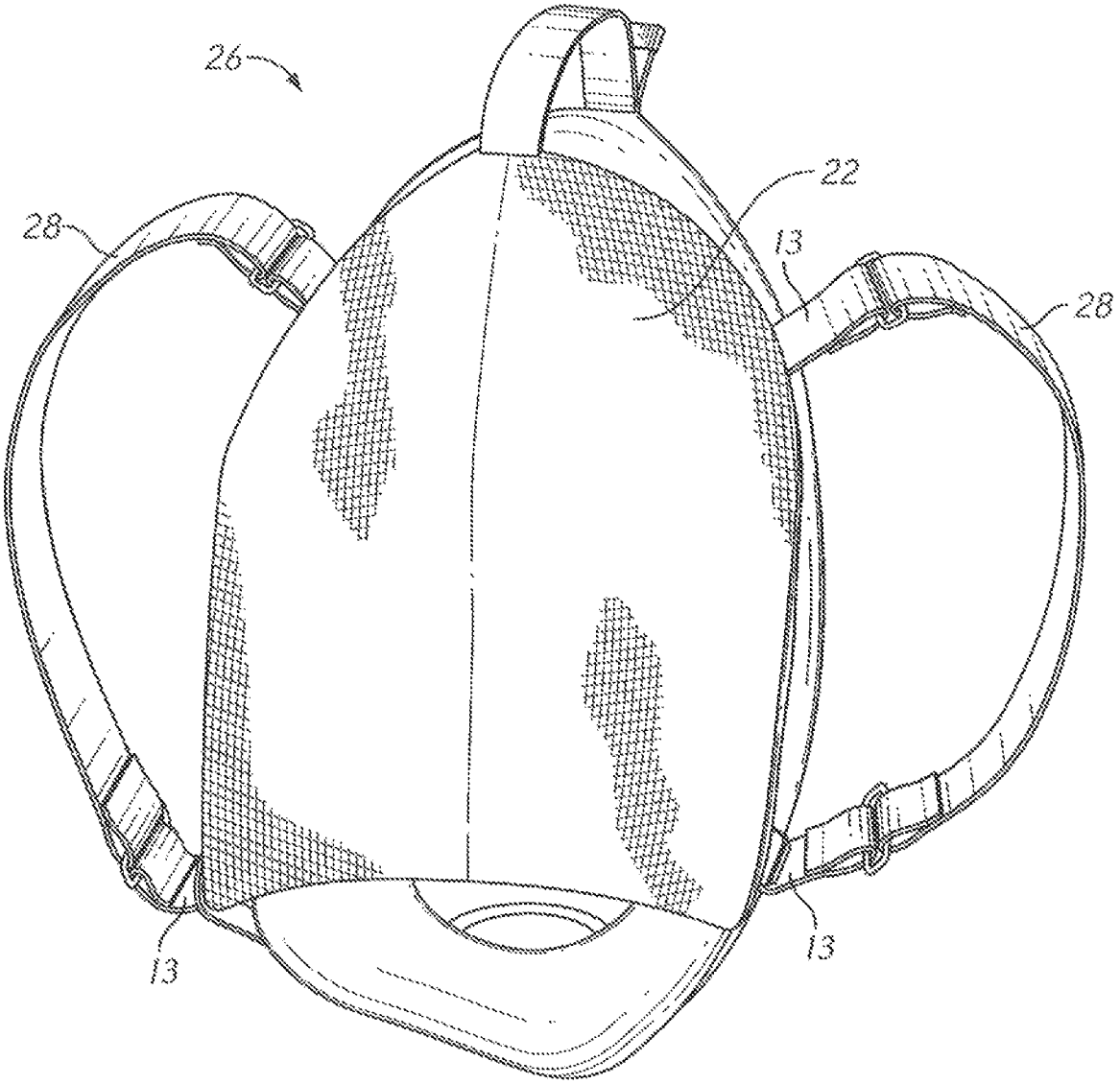
FIG. 4 is a perspective view of the back of an embodiment of the present invention.

A rearward view of the present attachment mechanism 26 is shown in FIG. 4. Central patch 22 contacts the rear of user's head. Modified straps 13 have an initial end connected directly to central patch 22. The reader will note that modified straps 13 and central patch 22 are preferably fixed together to create a strong connection. The terminal end 32 of modified straps 13 loop through buckles and are engaged with connecting member 28. FIG. 4 shows two connecting members 28 extending outward away from central patch 22. Connecting member 28 connects a first terminal end 32 of a first modified strap 13 to a second terminal end 32 of a second modified strap 13. It is in this manner that a user can tighten two modified straps 13 with a single pull of a single connecting member 28. Again, this greatly reduces the safety hazard of having to take off protective gloves to properly seal a mask (if the user is wearing gloves) and also creates a more efficient and expedient way to seal a mask with one or both hands.

Figure 5:
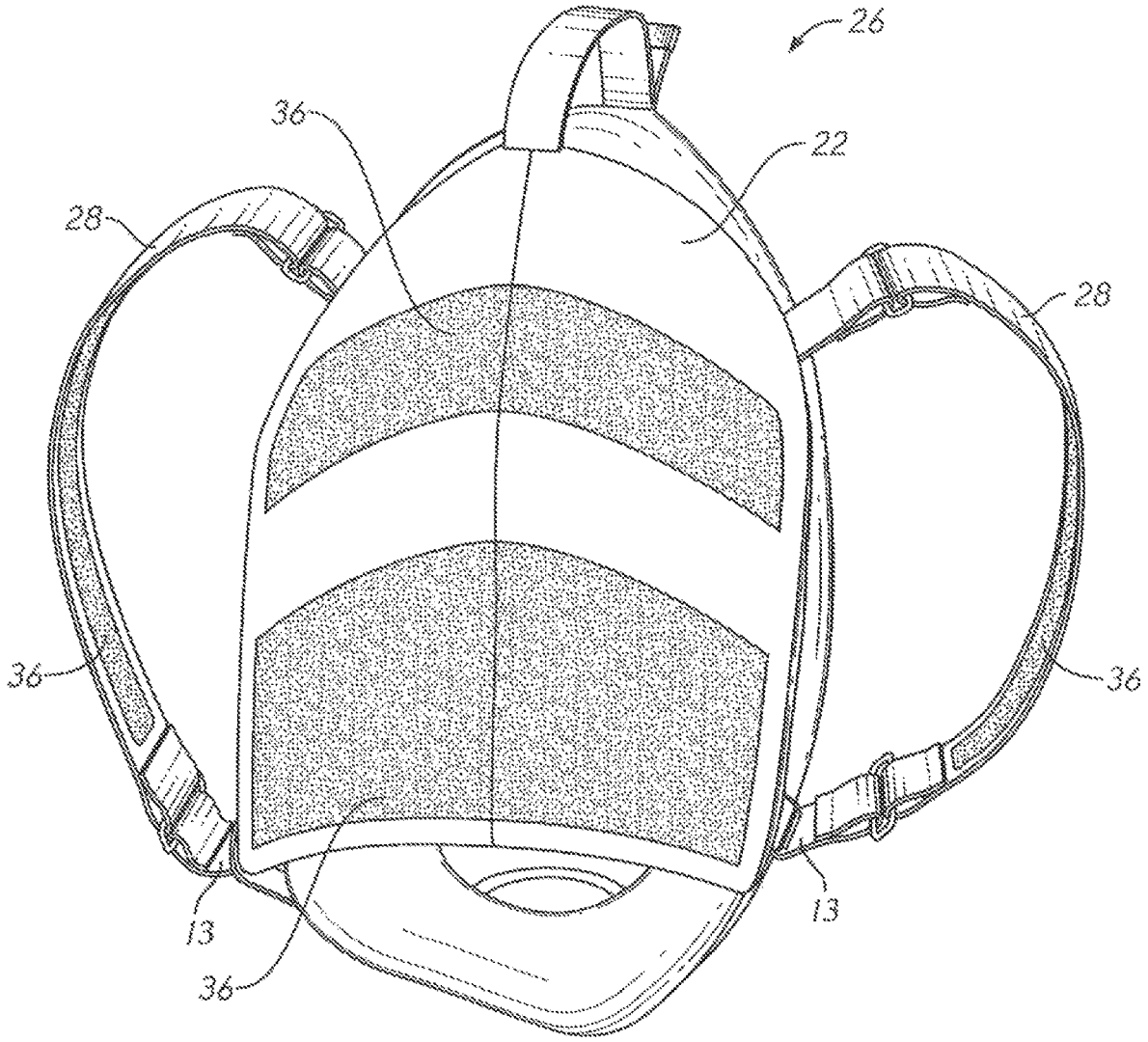
FIG. 5 is a perspective view of the back of an embodiment of the present invention with the addition of optional adherent material.
Figure 6:
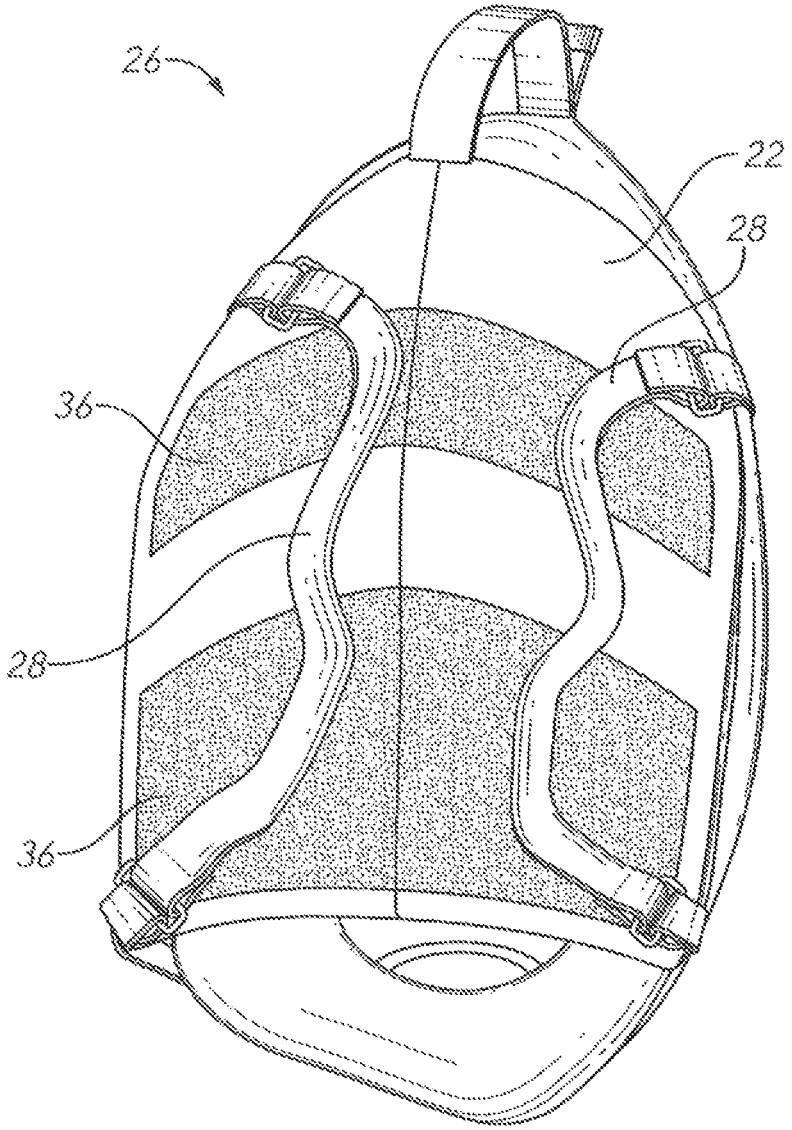
FIG. 6 is a perspective view of the device shown in FIG. 5, showing the placement of the connecting members on the optional adherent material.

FIGS. 5-6 show another embodiment of the present attachment mechanism 26. In this embodiment, each connecting member 28 includes an adherent material 36 and the rearward facing side of central patch 22 also contains an adherent material 36. Adherent material 36 of connecting member 28 can be any material that is capable of engaging with adherent material 36 of central patch 22. For example, industrial hook and loop (Velcro®) material can be used. Once connecting members 28 are used to tighten face mask, the user is able to attach connecting member 28 to the rearward facing side of central patch 22. Thus, a user can effectively keep connecting member 28 secured and out of the way. When needed, the connecting members 28 can be easily pulled away from the adherent material 36 of central patch 22. This advantage reduces the safety hazard that may be presented to a user sealing a face mask because the straps will not inadvertently get stuck in the seal of the mask.

Figure 7:
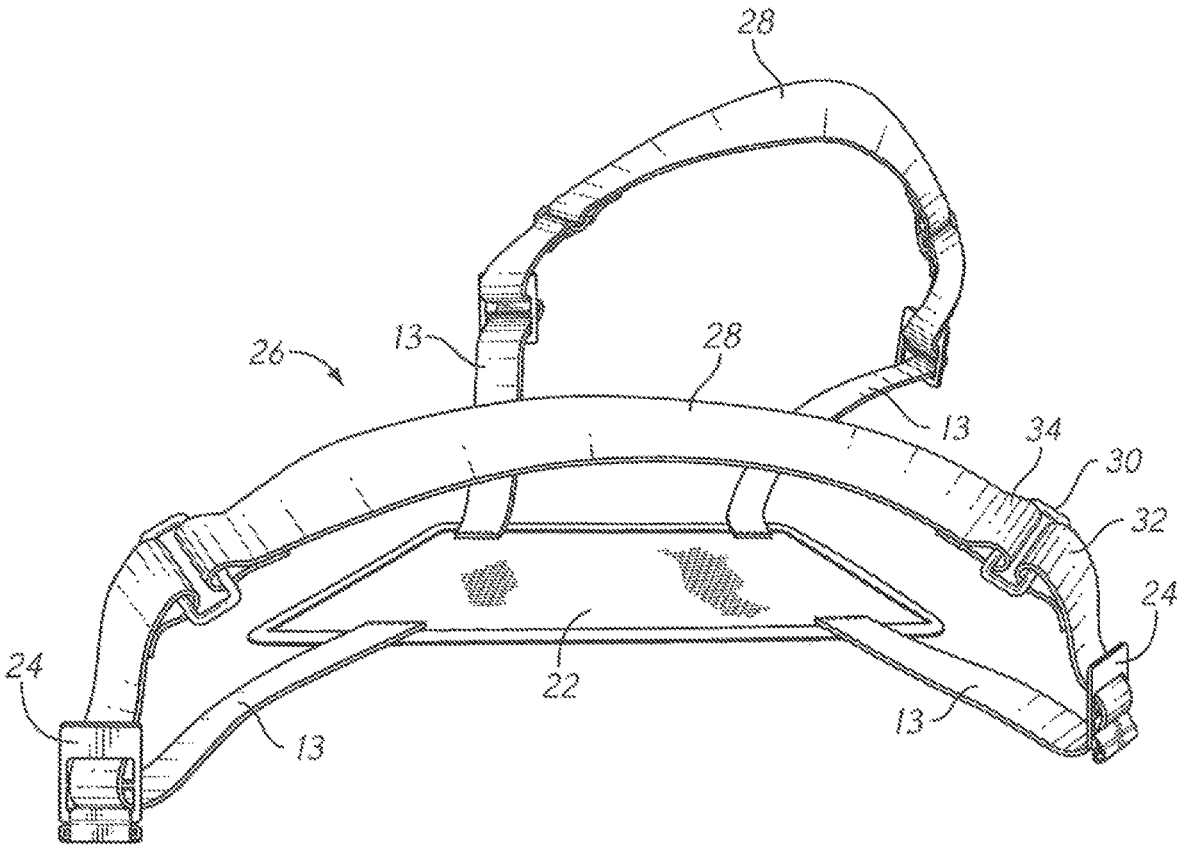
FIG. 7 is a side view of an embodiment of the present invention.

FIG. 7 illustrates one embodiment of attachment mechanism 26. Attachment mechanism 26 generally comprises central patch 22 with four modified straps 13 extending therefrom. Modified straps 13 extend to at least four buckles 24 which connect to seam (not shown) of face mask. At least two connecting members 28, each having a first and second connecting end 34, attach a first modified strap 13 to a second modified strap 13 and a third modified strap 13 to a fourth modified strap 13, respectively. Connecting members 28 can be pulled away from buckles 24 causing the length of modified strap 13 that extends from central patch 22 to buckle 24 to shorten. It is the attachment of modified straps 13 to connecting members 28 that allows a user the ability to expeditiously and safely secure a face mask with one or both hands. This advantage eliminates the safety hazard of removing gloves while in a contaminated atmosphere and allows for reduced time in securing a face mask. The reader will appreciate that connecting member 28 can be any shape or size so long as it is capable of connecting a terminal end 32 of a first modified strap 13 to a terminal end 32 of a second modified strap 13. Terminal end 32 of modified straps 13 is configured as an attachment point. In the present embodiment the terminal end 32 is a loop. The terminal end 32 is fixed to a link 30 which in turn is fixed to connecting end 34 of connecting member 28. While this is one manner of attaching connecting member 28 to terminal end 32 of modified straps, any known method of engaging the two pieces could be used, such as snaps, clips, buttons, hook and loop connection, etc.

Figure 8:
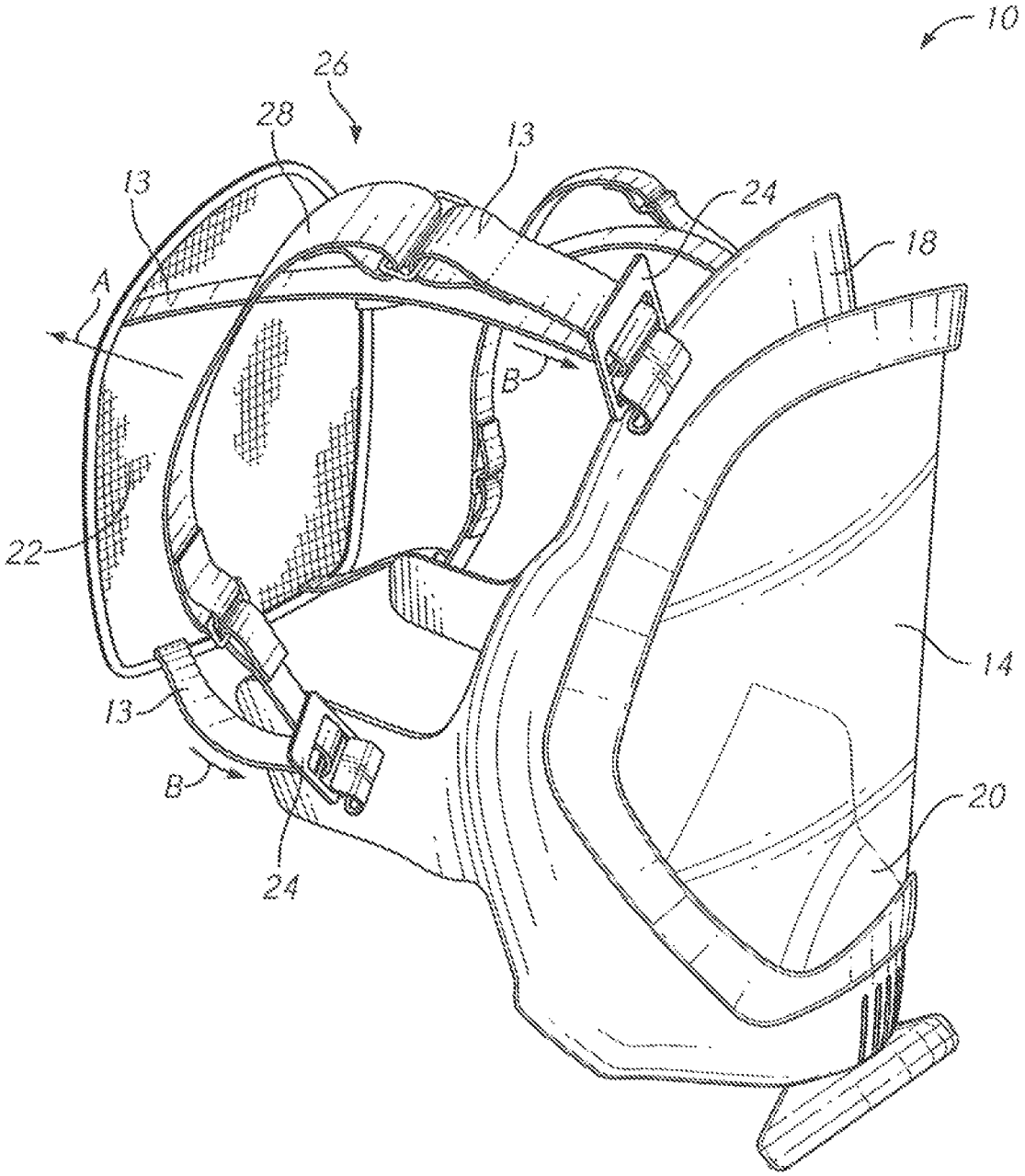
FIG. 8 is a perspective view, showing the direction of force to be applied to the connecting members.

FIG. 8 illustrates the direction of force applied to connecting members 28 in order to shorten the length of modified straps between central patch 22 and buckles 24. The force that the user applies to connecting member 28 is shown by arrow A (rearward force—i.e. away from the faceplate 14). As the user pulls in a rearward direction the length of first modified strap 13 and second modified strap 13 that has not yet slid through buckles 24 moves in the opposite direction as arrow A (shown as arrow B). As the length of the modified straps 13 between central patch 22 and the series of buckles 24 decreases, central patch 22 and seal 18 are further secured to the user's head and face. A user can quickly and efficiently tighten the mask by simply pulling backwards on connecting member 28. Connecting member 28 can be grasped easily, even when wearing large gloves. Because the user only must pull on two connecting members 28 to shorten four modified straps 13, the user increases the speed and efficiency with which the user can secure the mask. This greatly reduces the safety hazard of taking valuable time in an emergency, and/or requiring a user to take off protective gloves to properly secure a face mask, if the user is wearing gloves.

The previously described versions of the present invention have many advantages. The device 20 allows the user to tighten his or her mask. 22 with one motion. This reduces the time it takes for the user to don his or her mask. The device 20 also allows the user the tighten his or her mask quickly and while simultaneously wearing gloves, eliminating the safety hazard that or having to take off said gloves. The reader will appreciate that the invention does not require all the advantageous features to be incorporated into every embodiment of the invention.

Although the present invention has been described in considerable detail with reference to certain preferred versions thereof, other versions are possible. Therefore, the spirit and scope of the appended claims should not be limited to the description of the preferred versions contained herein. The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Having described the invention, what is claimed is:

1. An attachment device, for use with a face mask having a series of buckles, comprising:

a series of modified straps, having a length, an initial end, and a terminal end, wherein said length is engaged with said series of buckles;

wherein said initial end of said series of modified straps is connected to a central patch;

wherein said terminal end of said series of modified straps is engaged with a series of connecting members; and wherein a force can be applied to said connecting members such that said length of said series of modified straps moves through said series of buckles.

2. The attachment device of claim 1, wherein said series of modified straps further comprises a first strap, a second strap, a third strap, and a fourth strap.

3. The attachment device of claim 2, wherein said series of connecting members further comprises a first connecting member and a second connecting member.

4. The attachment device of claim 3, wherein said first connecting member connects said terminal end of said first strap to said terminal end of said second strap; and wherein said second connecting member connects said terminal end of said third strap to said terminal end of said fourth strap.

5. The attachment device of claim 1, wherein said series of connecting members are handles.

6. The attachment device of claim 1, wherein said central patch has a rear side with an adherent material affixed thereto; wherein said series of connecting members have an adherent material affixed thereto; and wherein said series of connecting members are capable of adhering to said rear side of said central patch.

7. The attachment device of claim 3, wherein said terminal end of said series of modified straps is a loop, and said first connecting member and said second connecting member father comprise a link for receiving said loop.

8. An attachment device, for use with a face mask having a series of buckles, comprising:

a series of modified straps, having a length, an initial end, and a terminal end, wherein said length is engaged with said series of buckles;

wherein said initial end of said series of modified straps is connected to a central patch, wherein said central patch has a rearward facing side;

wherein said terminal end of said series of modified straps is engaged with a series of connecting members; and wherein a force can be applied in a rearward direction to said series of connecting members such that said length of said series of modified straps moves through said series of buckles thereby shortening said length of said series of modified straps that exists between said central patch and said seal.

9. The attachment device of claim 8, wherein said series of connecting members comprise a first connecting member and a second connecting member; and wherein said series of straps comprises a first strap, a second strap, a third strap, and a fourth strap.

10. The attachment device of claim 9, wherein said first connecting member connects said terminal end of said first strap to said terminal end of said second strap; and wherein said second connecting member connects said terminal end of said third strap to said terminal end of said fourth strap.

11. The attachment device of claim 8, wherein said series of connecting members are handles.

12. The attachment device of claim 8, wherein said series of connecting members further comprise a first adherent material and said rearward facing side of said central patch further comprise a second adherent material such that said first adherent material on said series of connecting members and said second adherent material on said central patch are capable of engaging with one another.

13. The attachment device of claim 8, wherein said terminal end of said series of modified straps connects to said series of connecting members by way of a link.

14. An attachment device for a face mask having a seal, wherein said seal further comprises a frame, a faceplate, and a first buckle, a second buckle, a third buckle and a fourth buckle attached to said seal, wherein said attachment device comprises:

a first modified strap, a second modified strap, a third modified strap and a fourth modified strap, wherein said first, second, third and fourth modified strap each have a length, an initial end and a terminal end;

wherein said length of said first, second, third and fourth modified straps are engaged with said first, second, third and fourth buckle respectively;

wherein said initial end of said first, second, third and fourth modified straps connect independently to a central patch having a rearward facing side;

wherein said terminal end of said first modified strap engages with a first connecting end of a first connecting member, and said second modified strap engages with a second connecting end of said first connecting member; and wherein said terminal end of said third modified strap engages with a first connecting end of a second connecting member and said fourth modified strap engages with a second connecting end of said second connecting member.

15. The attachment device of claim 14, wherein a force can be applied in a rearward direction to said first connecting member and said second connecting member such that said length of said first modified strap, said second modified strap, said third modified strap and said fourth modified strap moves through said first, second, third and fourth buckler thereby shortening said length of said first modified strap, second modified strap, third modified strap and fourth modified straps that exists between said central patch and said seal.

16. The device of claim 14, wherein said first connecting member and said second connecting members are handles.

17. The device of claim 14, wherein said first and second connecting members further comprise a first adherent material and said rearward facing side of said central patch further comprise a second adherent material such that said first connecting member and said second connecting members can adhere to said rearward facing side of said central patch.

18. The device of claim 14, further comprising a loop at said terminal end of said first, second, third and fourth modified straps said first and second connecting end of said first connecting member and said first and second connecting end of said second connecting member each further comprise a link for receiving said loop of said first, second, third and fourth modified strap.

* * * * *